US012209818B2

(12) United States Patent
Gavenas et al.

(10) Patent No.: US 12,209,818 B2
(45) Date of Patent: Jan. 28, 2025

(54) LOUVER ASSEMBLY FOR A COOLING TOWER

(71) Applicant: Brentwood Industries, Inc., Reading, PA (US)

(72) Inventors: Nicholas Emil Gavenas, Ephrata, PA (US); Joshua Livezey, Reading, PA (US)

(73) Assignee: Brentwood Industries, Inc., Reading, PA (US)

( * ) Notice: Subject to any disclaimer, the term of this patent is extended or adjusted under 35 U.S.C. 154(b) by 394 days.

(21) Appl. No.: 17/856,573

(22) Filed: Jul. 1, 2022

(65) Prior Publication Data

US 2023/0003469 A1 Jan. 5, 2023

Related U.S. Application Data

(60) Provisional application No. 63/217,924, filed on Jul. 2, 2021.

(51) Int. Cl.
*F28F 25/08* (2006.01)

(52) U.S. Cl.
CPC ..... *F28F 25/085* (2013.01)

(58) Field of Classification Search
CPC ..... F28F 25/085
USPC ..... 261/111, DIG. 11, DIG. 85
See application file for complete search history.

(56) References Cited

U.S. PATENT DOCUMENTS 1,632,397 A * 6/1927 Fluor ..... F28F 25/082 261/DIG. 11
2,680,603 A * 6/1954 Taylor ..... F28C 1/12 261/24
3,235,234 A * 2/1966 Beaudoin ..... C02F 7/00 210/150
3,850,595 A * 11/1974 Forchini ..... F28F 25/02 96/356
4,217,317 A * 8/1980 Neu ..... F28B 1/06 261/DIG. 11
4,263,842 A * 4/1981 Moore ..... F24F 13/15 415/908
4,361,426 A * 11/1982 Carter ..... F28F 25/087 55/440
4,706,554 A * 11/1987 Baldino ..... F28F 25/12 261/DIG. 11
6,083,302 A * 7/2000 Bauver, II ..... B01D 53/504 55/440
6,293,527 B1 * 9/2001 Ovard ..... B01J 19/32 261/DIG. 11
7,655,069 B2 * 2/2010 Wright ..... B01D 53/14 96/134
11,988,451 B2 * 5/2024 Lingle ..... F28C 1/16
2005/0006798 A1 * 1/2005 Hegg ..... F28F 25/00 261/112.2
2009/0017748 A1 * 1/2009 Bugler, III ..... F24F 13/075 454/271

(Continued)

*Primary Examiner* — Charles S Bushey
(74) *Attorney, Agent, or Firm* — Design IP

(57) ABSTRACT

A louver assembly includes a blade array having a plurality of nested blades that are horizontally aligned, each of the plurality of blades being spaced apart from an adjacent blade by a plurality of spacers, each of the plurality of blades having a blade longitudinal axis, wherein each of the plurality of spacers is oriented at a non-orthogonal angle relative to the blade longitudinal axis.

20 Claims, 14 Drawing Sheets

(56) References Cited

U.S. PATENT DOCUMENTS

| | | | | |
|---|---|---|---|---|
| 2012/0001352 | A1* | 1/2012 | Carter | F28D 5/02 261/DIG. 11 |
| 2017/0050168 | A1* | 2/2017 | Kehrer | B32B 7/08 |
| 2024/0271872 | A1* | 8/2024 | Lingle | F28C 1/16 |

* cited by examiner

LOUVER ASSEMBLY FOR A COOLING TOWER

BACKGROUND

Water loss to the environment due to the evaporative cooling process is common in cooling towers. Such evaporation is typically in the form of pure water vapor and presents no risk of harm to the environment. Cooling tower splash out occurs when the cooling fluid exits in the air inlet side of the tower. The water droplets are large enough in size and contain enough momentum to travel in the opposite direction of the incoming air and fall outside the cooling tower water basin. Such water droplets can carry chemicals and minerals which have a deleterious impact on the outside environment, such as the corrosion of manmade structures and damage to plant life. Additionally, wet conditions around the exterior of the cooling tower are unsafe for personnel. In addition, it is desirable that louver assemblies prevent light bypass, which reduces algae growth in the cooling tower.

To combat this problem, the cooling tower industry has developed louver panels, slats and assemblies, which are designed to collect and redirect the splashing out water back into the water basin. There are two main types of louvers—slats and panels. Slat style louvers are installed the length of the air inlet in a horizontal fashion. Water that hits the slats bounces back into the tower. This type of louver has a relatively low pressure drop, but provides the least amount of splash out prevention and does little to reduce light by-pass. Panel style louvers use a tubular design to allow air to flow through the tube channels but prevent water from exiting by forming a "wall" at the inlet. Panel style louvers generally have better light by-pass prevention characteristics than slat-style louvers. Panel style louvers have more limited options for size.

Many existing louvers are manufactured out of polymetric or organic material such as PVC, FRP and wood. These products are flammable and have operating temperature limits based the on the material. In some cases, is it desirable to have non-combustible louvers or louvers which have a higher operating temperature range in excess of 125 degrees F. (52 degrees C.). Conventional louver materials also lack a desired level of corrosion resistance.

Accordingly, there is a need for a louver assembly system that is modular and able to be used in high-temperature and/or corrosive applications, while maintaining a reasonable cost.

SUMMARY

Several specific aspects of the systems and methods of the subject matter disclosed herein are outlined below.

Aspect 1: An apparatus comprising:

a blade array comprising a plurality of blades, each of the plurality of blades being spaced apart from an adjacent blade by a plurality of spacers, each of the plurality of blades having a longitudinal axis $L_B$, the longitudinal axis $L_B$ of each of the plurality of blades being collectively parallel, each of the plurality of spacers having a longitudinal axis $L_S$, wherein the longitudinal axis $L_S$ of each of the plurality of spacers is non-orthogonal to the longitudinal axis $L_B$.

Aspect 2: The apparatus of Aspect 1, wherein the blade array and the plurality of spacers are secured and aligned by a plurality of rods, each of the plurality of rods having a longitudinal axis $L_R$, the longitudinal axis $L_R$ being orthogonal to the longitudinal axis $L_B$, each of the plurality of rods having a first rod end and second rod end and at least one fastener secured to each of the first and second rod ends.

Aspect 3: The apparatus of Aspect 2, wherein each of the plurality of rods comprises a bolt, the first rod end is threaded, and the at least one fastener comprises a nut secured to the first rod end and a head located at the second rod end.

Aspect 4: The apparatus of any of Aspects 2-3, wherein each of the plurality of rods extends through all of the plurality of blades.

Aspect 5: The apparatus of any of Aspects 2-4, wherein each of the plurality of spacers is located in one of a plurality of spacer arrays and each of the plurality of rods passes through all of the spacers in one of the plurality of spacer arrays.

Aspect 6: The apparatus of any of Aspects 1-5, wherein each of the plurality of blades comprises a plurality of alignment slots and each of the plurality of spacers comprises a plurality of alignment tabs, wherein each of the plurality of alignment slots is shaped and located to receive at least one of the alignment tabs.

Aspect 7: The apparatus of any of Aspects 1-6, wherein each of the plurality of spacers has first and second legs connected by a support strip, the support strip having a rod aperture formed therein.

Aspect 8: The apparatus of any of Aspects 1-7, wherein each of the plurality of blades comprises a linear outer leg and a linear inner leg that are connected by a curved portion.

Aspect 9: The apparatus of any of Aspects 1-8, wherein each of the plurality of blades has an inner blade edge and an outer blade edge, the inner blade edge and the outer blade edge being parallel to the longitudinal axis $L_B$.

Aspect 10: The apparatus of any of Aspects 1-9, wherein a longitudinal axis $L_S$ of each of the plurality of spacers forms and angle $A_3$ with the longitudinal axis $L_B$ of each of the plurality of blades, wherein angle $A_3$ is between 45 and 80 degrees.

Aspect 11: The apparatus of any of Aspects 1-10, wherein a longitudinal axis $L_S$ of each of the plurality of spacers forms and angle $A_3$ with the longitudinal axis $L_B$ of each of the plurality of blade and the angle $A_3$ is substantially identical for each of the plurality of spacers.

Aspect 12: A blade array comprising:

a plurality of blades, a plurality of spacers, a plurality of rods, each of the plurality of blades having a longitudinal axis $L_B$, an inner blade edge, an outer blade edge, the inner blade edge and the outer blade edge being parallel to the longitudinal axis $L_B$, each of the plurality of rods having first and second rod ends and a first fastener located at the first rod end a second fastener located at the second rod end;

wherein each of the plurality of blades and the plurality of spacers has at least one rod aperture and one of the plurality of rods extends through each of the at least one rod aperture;

wherein each of the plurality of blades is spaced apart from an adjacent one of the plurality of blades by at least two spacers of the plurality of spacers, thereby defining an air channel, each air channel having an upper blade of the plurality of blades and a lower blade of the plurality of blades; and wherein a shape and spacing of each of the plurality of blades is adapted so that, for each air channel, a line extending from the inner edge of the upper blade to the outer edge of the lower blade intersects a portion of the lower blade.

Aspect 13: The blade array of Aspect 12, wherein each of the plurality of rods has a longitudinal axis $L_R$, the longitudinal axis $L_R$ being orthogonal to the longitudinal axis $L_B$ of each of the plurality of blades.

Aspect 14: The blade array of Aspect 13, wherein each of the plurality of rods comprises a bolt, the first rod end is threaded, the first fastener comprises a nut, and second fastener comprises a bolt head locate at the second rod end.

Aspect 15: The blade array of any of Aspects 12-14, wherein each of the plurality of rods extends through all of the plurality of blades.

Aspect 16: The blade array of any of Aspects 12-15, wherein each of the plurality of blades comprises a plurality of alignment slots and each of the plurality of spacers comprises a plurality of alignment tabs, wherein each of the plurality of alignment slots is shaped and located to receive at least one of the alignment tabs.

Aspect 17: The blade array of any of Aspects 12-16, wherein each of the plurality of spacers has first and second legs connected by a support strip, the support strip having one of the plurality of rod apertures formed therein.

Aspect 18: The blade array of any of Aspects 12-17, wherein each of the plurality of blades comprises a linear outer leg and a linear inner leg that are connected by a curved portion.

Aspect 19: The blade array of Aspect 18, wherein the curved portion has a radius of curvature R that is between 0.4 and 0.8 inches.

Aspect 20: The blade array of any of Aspects 18-19, wherein at least two of the plurality of rod apertures is located in the curved portion of each of the plurality of blades.

BRIEF DESCRIPTION OF THE DRAWINGS

For a more complete understanding of the present invention, reference is made to the following detailed description of embodiments considered in conjunction with the accompanying drawings, in which.

DETAILED DESCRIPTION

Figure 1:
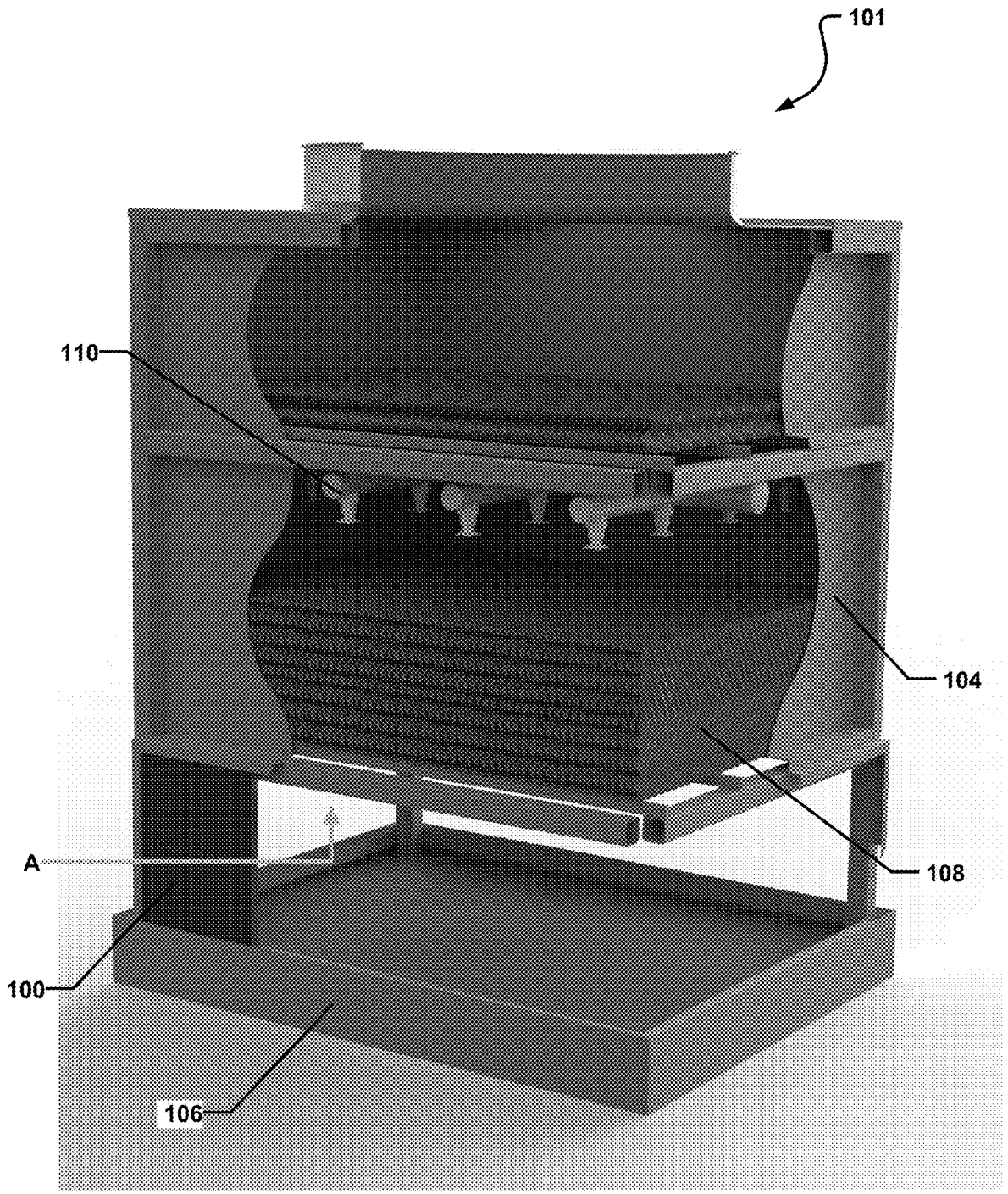
FIG. 1 is a schematic view of the interior of a cooling tower having a counterflow configuration.

The following disclosure is presented to provide an illustration of the general principles of the present invention and is not meant to limit, in any way, the inventive concepts contained herein. Moreover, the particular features described in this section can be used in combination with the other described features in each of the multitude of possible permutations and combinations contained herein.

All terms defined herein should be afforded their broadest possible interpretation, including any implied meanings as dictated by a reading of the specification as well as any words that a person having skill in the art and/or a dictionary, treatise, or similar authority would assign particular meaning. Further, it should be noted that, as recited in the specification and in the claims appended hereto, the singular forms "a," "an," and "the" include the plural referents unless otherwise stated. Additionally, the terms "comprises" and "comprising" when used herein specify that certain features are present in that embodiment but should not be interpreted to preclude the presence or addition of additional features, components, operations, and/or groups thereof.

The following disclosure is intended to be read in connection with the accompanying drawings, which are to be considered part of the entire written description of the invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship.

The present invention relates to a louver assembly that is configured to be installed in either a counterflow or crossflow configuration in a cooling tower system. FIG. 1 illustrates a first exemplary cooling tower 101 in which a louver assembly 100 is installed in a counterflow configuration. The cooling tower 101 may include a cooling tower housing 104 that may be positioned over a water basin 106. Further, the cooling tower housing 104 may include fill media 108 that may be positioned above the water basin 106. A plurality of nozzles 110 may be positioned above the fill media 108.

As shown in FIG. 1, the louver assembly 100 may be positioned at least partially around the water basin 106. The louver assembly 100 may be positioned so that the louver assembly 100 is substantially vertical. The nozzles 110 may be directed to distribute hot water over the fill media 108, which may cool the hot incoming water by mixing it with cool air. The louver assembly 100 may be configured to allow air to flow into the cooling tower 101 and upward through the fill media 108 (as indicated by arrow A). The louver assembly 100 preferably is configured to prevent sunlight from entering the cooling tower 101 through the louver assembly 100. Moreover, the louver assembly 100 may prevent droplets of water falling downward into the basin from exiting the cooling tower 101.

Figure 2:
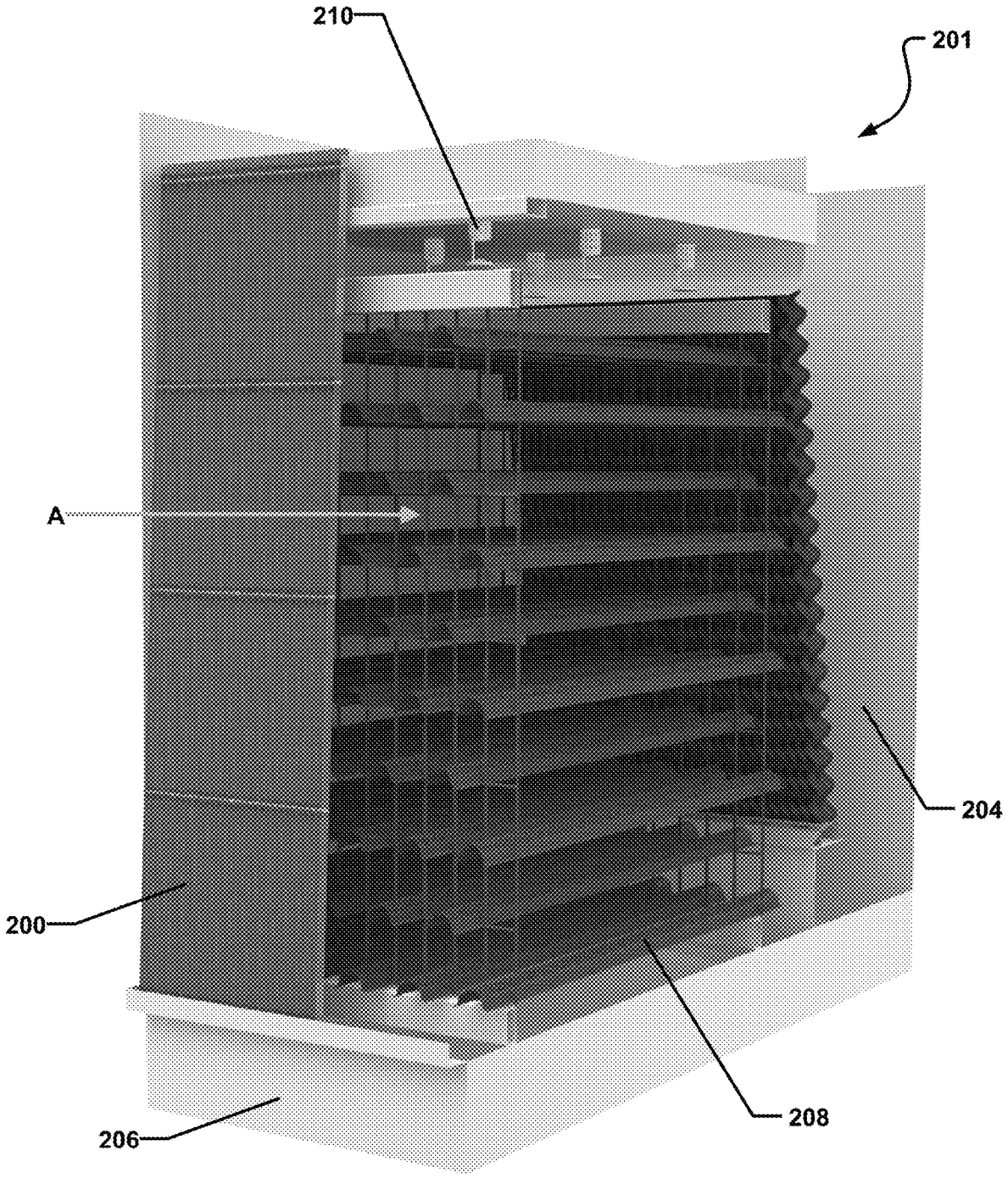
FIG. 2 is a schematic view of the interior of a cooling tower having a crossflow configuration.

FIG. 2 illustrates a second exemplary cooling tower 201 in which a louver assembly 200 is installed in a crossflow configuration. The cooling tower 201 may include a cooling tower housing 204 that may be positioned over a water basin 206. The cooling tower housing 204 may include fill media 208 that may be positioned above the water basin 206. A plurality of nozzles 210 may be positioned above the fill media 208. Further, the louver assembly 200 may be positioned to the side of the fill media 208. In particular the louver assembly 200 may be positioned so that the louver assembly 200 is substantially vertical. In another aspect, the louver assembly 200 may be positioned so that the louver assembly 200 is slightly angled with respect to vertical.

The nozzles 210 may be directed to distribute hot water over the fill media 208, which may cool the hot incoming water through evaporation into the air. The louver assembly 200 may be configured to allow air to flow into the cooling tower 201 and horizontally across, or through, the fill media 208 (as indicated by arrow A). The louver assembly 200 is preferably configured to prevent sunlight from entering the cooling tower 201. Moreover, the louver assembly 200 may prevent droplets of water falling downward into the basin from exiting the cooling tower 201. It should be understood that the exemplary cooling towers 101, 201 are two of many possible cooling tower configurations and are provided for the purpose of illustrating the environment in which the louver assembly 100, 200 could be used.

Referring now to FIGS. 3-14 an exemplary embodiment of a louver assembly 300 is shown. It is to be understood that the louver assembly 300 may be installed as shown in FIG. 1 or FIG. 2. The louver assembly 300 includes a plurality of blades 302*a*-302*o* that are spaced apart by a plurality of asymmetric spacers 304*a*-304*o* and arranged in a horizontally-aligned array.

One layer of asymmetric spacers 304*a*-304*o* is preferably positioned between each of the blades 302*a*-302*o*. In this exemplary embodiment, each layer includes three asymmetric spacers 304*a*-304*o* and as described in greater detail below, each asymmetric spacer 304*a*-304*o* may be placed at an angle with respect to a longitudinal axis $L_b$ of the louver assembly 300, or a longitudinal axis of each blade 302*a*-302*o* of the louver assembly 300 (which is parallel to longitudinal axis $L_b$). In other embodiments, any number of spacers could be provided in each layer.

In this embodiment, the blades 302*a*-302*o* and spacers 304*a*-304*o* are held together by threaded bolts 306*a*, 306*b*, 306*c* that are secured on each end by nuts 308*a*-308*f*. Alternately, any suitable fastener could be substituted for the nuts 308*a*-308*f*. For example, cotter pins, clamps, wire, clips, or a welded piece could be used, or the ends of the rods could be bent or flattened to provide a fastening function. Each spacer (for example, spacer 304*a*) is positioned between a pair of adjacent blades (for example, blades 302*a*, 302*b*), ensuing) and each pair of adjacent blades (for example, blades 302*a*, 302*b*) has two or more spacers of the plurality of spacers 304*a*-304*o* positioned therebetween (see, e.g., spacers 304*a* and 304*b* in FIG. 3), ensuring that an air channel 310*a*-310*n* is established between each adjacent pair of blades (for example, blades 302*a*, 302*b*).

Figure 13:
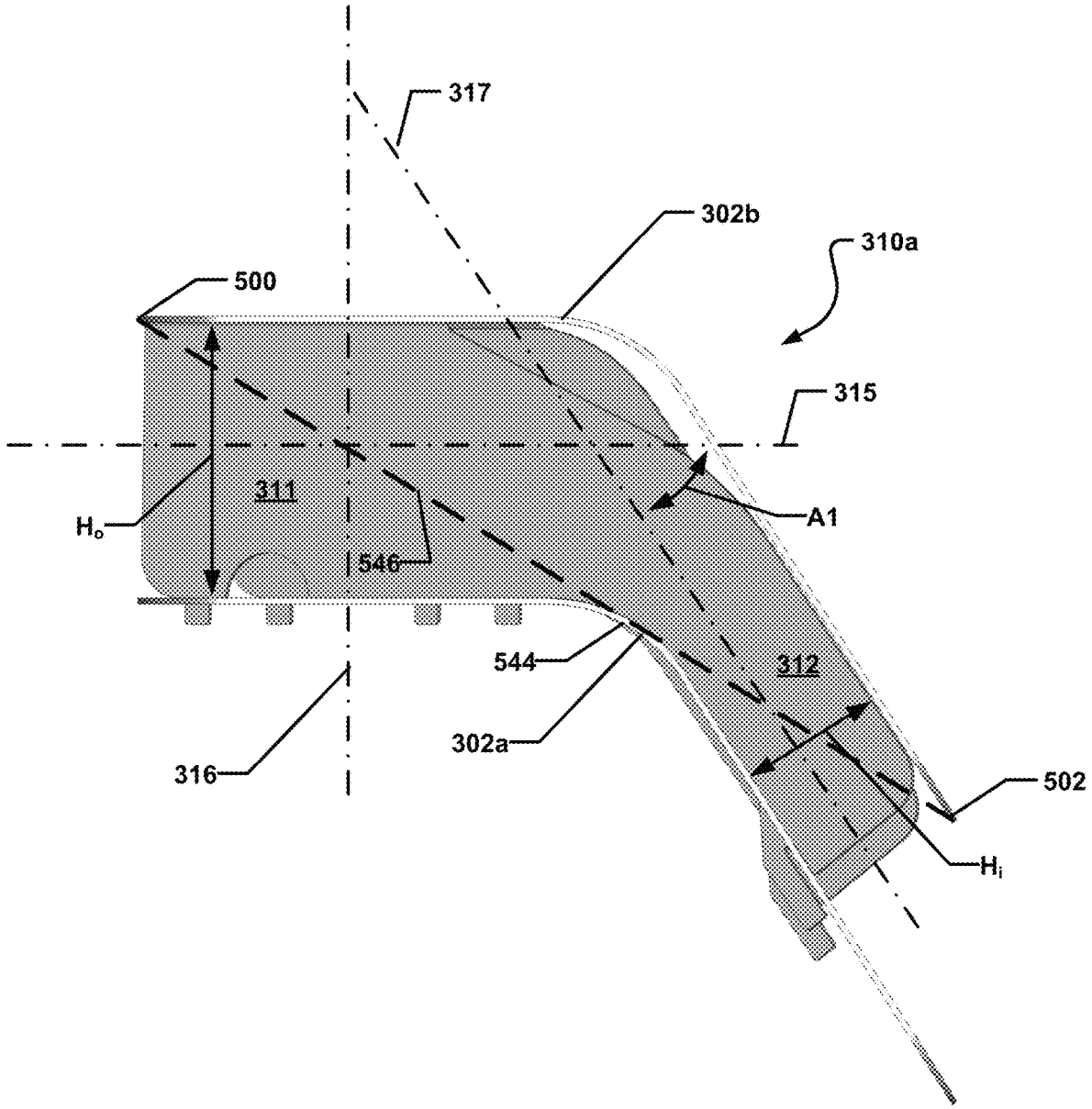
FIG. 13 is a top elevational view of the spacer installed between adjacent blades.

FIG. 13 illustrates a single air channel 310*a*, which is representative of each of the air channels 310*a*-310*n* of the louver assembly 300. The air channel 310*a* includes an outer portion 311 and an inner portion 312. In this embodiment, the outer portion 311 of the air channel 310*a* has a longitudinal axis 315 is substantially perpendicular to a transverse axis 316 of the louver assembly 300 (also shown in FIG. 3), which is parallel to the threaded bolts 306*a*, 306*b*, 306*c* and extends perpendicularly through each blade 302*a*-302*o* of the louver assembly 300. The inner portion 312 of the air channel 310*a* preferably extends along a longitudinal axis 317 that extends at an acute angle A1 with respect to the longitudinal axis 315 of the outer portion 311. In particular, the inner portion 312 of each air channel 310*a* may form an angle, A1, with respect to the transverse axis 316. In one aspect, angle A1 is preferably between 10 and 80 degrees and, more preferably, between 15 and 60 degrees and, most preferably, between 15 and 45 degrees.

As further illustrated in FIG. 13, the outer portion 311 of the air channel 310*a* may have a height, $H_o$, and the inner portion 312 of each air channel 310*a*-310*n* may have a height, H. As shown in FIG. 13, $H_o$ is preferably equal to or greater than H. More preferably, $H_o$ is greater than $H_i$. The height of the outer portion $H_o$ is preferably in the range 0.8-0.9 inches and, more preferably between 0.83 and 0.88 inches.

In another aspect, $H_o$ may be greater than or equal to 0.70 inches, such as greater than or equal to 0.75 inches, greater than or equal to 0.80 inches, greater than or equal to 0.85 inches, or greater than or equal to 0.86 inches. In another aspect, $H_o$ may be less than or equal to 1.00 inches, such as less than or equal to 0.95 inches, less than or equal to 0.90 inches. It can be appreciated that $H_o$ may be within a range between, and including, any of the minimum and maximum values of $H_o$ described herein.

Figure 14:
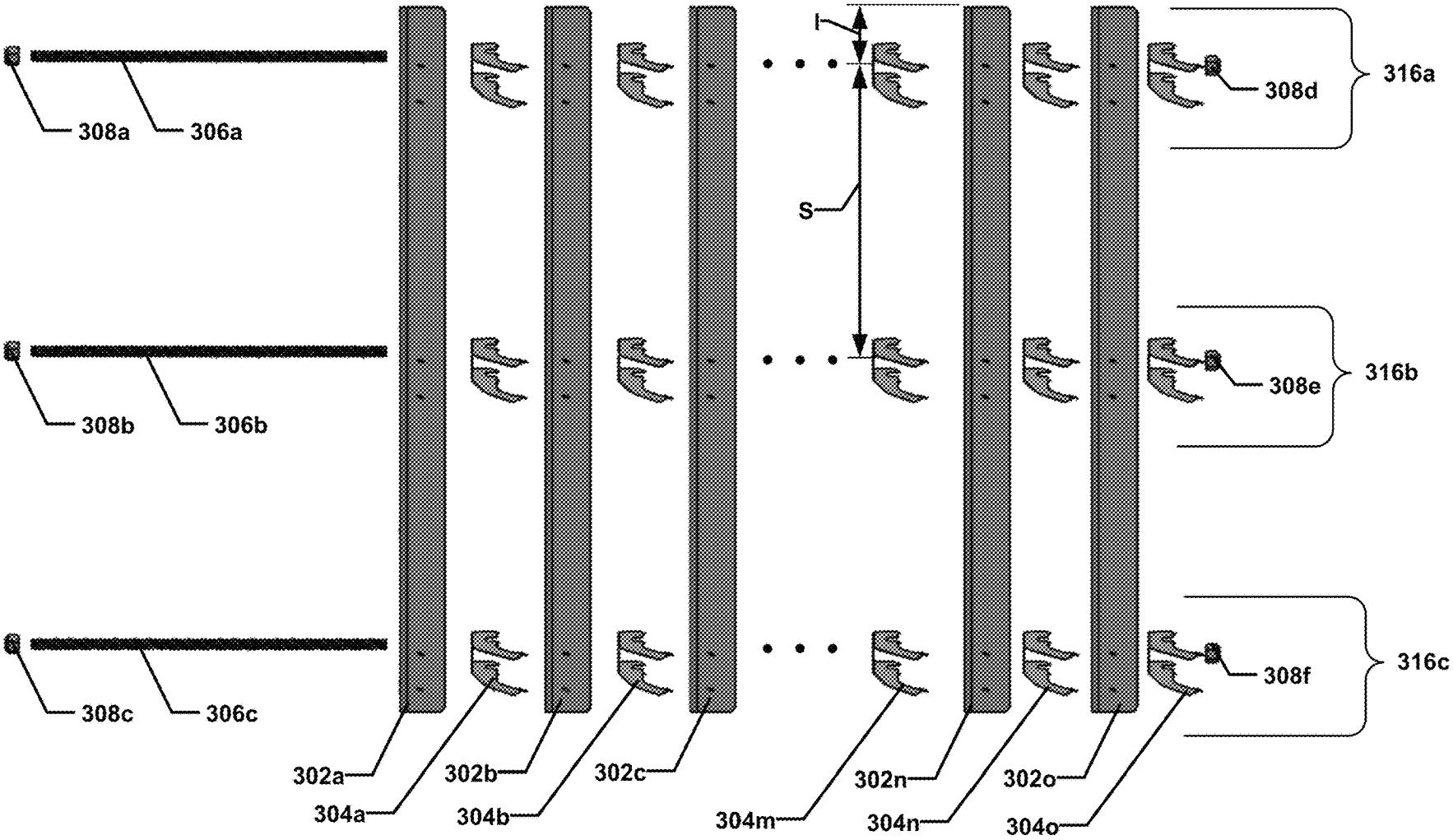
FIG. 14 is an exploded view of the louver assembly.

As shown in FIG. 14, the spacers 304*a*-304*o* are preferably arranged in horizontal arrays 316*a*, 316*b*, 316*c*. As illustrated, the louver assembly 300 may include three horizontal arrays 316*a*, 316*b*, 316*c*, but it can be appreciated that the louver assembly 300 may include more or less than three horizontal arrays 316*a*, 316*b*, 316*c*. Further, the horizontal arrays 316*a*, 316*b*, 316*c* may be spaced apart from each other along the length of the blades 302*a*-302*o* at a spacing, S. S may be measured between the center of adjacent spacers. In particular, S may be greater than or equal to five inches. Further, S may be greater than or equal to six inches, such as greater than or equal to eight inches, or greater than or equal to ten inches. In another aspect, S may be less than or equal to twenty-four inches, such as less than or equal to sixteen inches. It is to be understood that S may be within a range between an including any of the minimum and maximum values of S described herein.

In another aspect, the outer horizontal arrays 316*a* and 316*c*, which are located adjacent to the ends of the blades 302*a*-302*o* may be inset from the ends of the blades 302*a*-302*o* at an inset distance, I. Specifically, I may be less than or equal to six inches. Further, I may be less than or equal to five inches, such as less than or equal to four inches, or less than or equal to three inches. In another aspect, I may be greater than or equal to one inch, such as greater than or equal to two inches. It is to be understood that I may within a range between, and including, any of the maximum and minimum values of I described herein.

In a particular aspect, each of the plurality of spacers 304*a*-304*o* may be a separate structure from every other spacer 304*a*-304*o*. This is in contrast to conventional metal louver assemblies, in which each array of spacers is a unitary structure. The separate structure for the spacers of 304*a*-304*o* may provide greater modularity.

Figure 3:
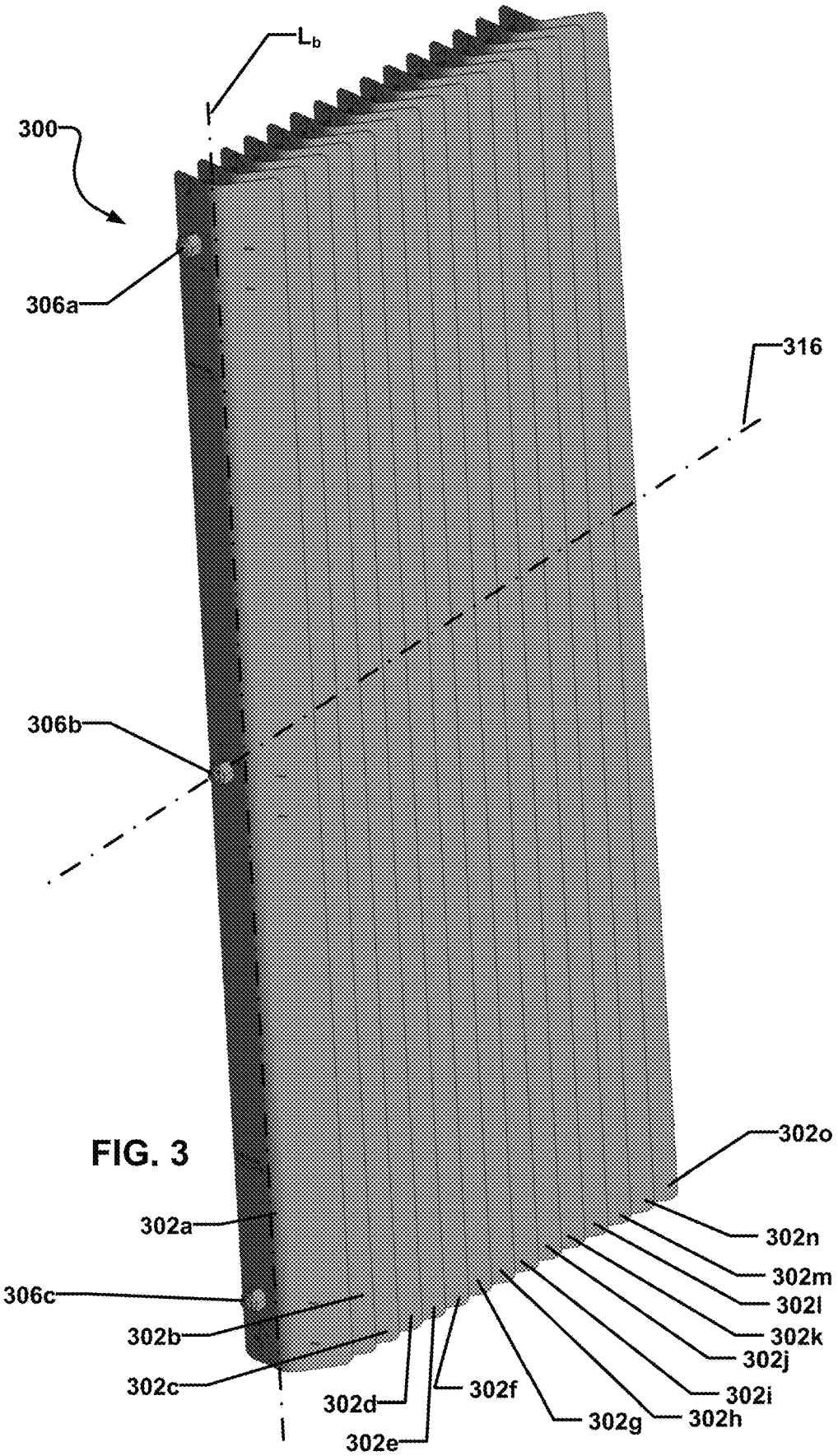
FIG. 3 is a perspective view of an exemplary louver assembly.
Figure 4:
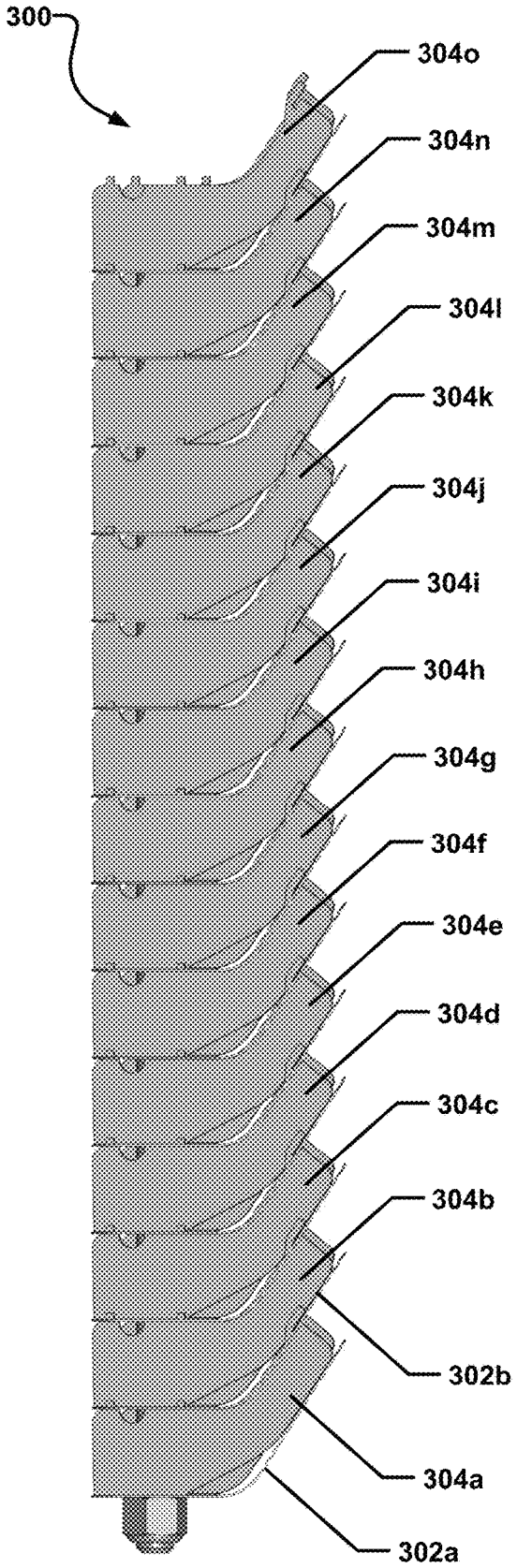
FIG. 4 is a top elevational view of the louver assembly.

FIG. 5 through FIG. 9 illustrate a first blade 302*a*, which is representative of each of the plurality of blades 302*a*-302*o* shown in FIG. 3 and FIG. 4. The first blade 302*a* may include an inner edge 500, an outer edge 502, a first end 504, and a second end 506. The first blade 302*a* may include a plurality of bolt holes 508*a*-508*c* positioned along the length of the first blade 302*a* and extending through the first blade 302*a* from an upper blade surface 510 to a lower blade surface 512. These bolt holes 508*a*-508*c* may be sized and shaped to receive a bolt (e.g., one of the bolts 306*a*, 306*b*, 306*c* shown in FIG. 3 and FIG. 14) which may be used to secure the plurality of blades 302*a*-302*o* and the plurality of spacers 304*a*-304*o* together to form the louver assembly 300 shown in FIG. 3. As shown, the first blade 302*a* may include three bolt holes 508*a*-508*c*, but it may be appreciated that depending on the length of the first blade 302*a*, the first blade 302*a* may include two bolt holes, three bolt holes, four bolt holes, five bolt holes, six bolt holes, etc.

Figure 6:
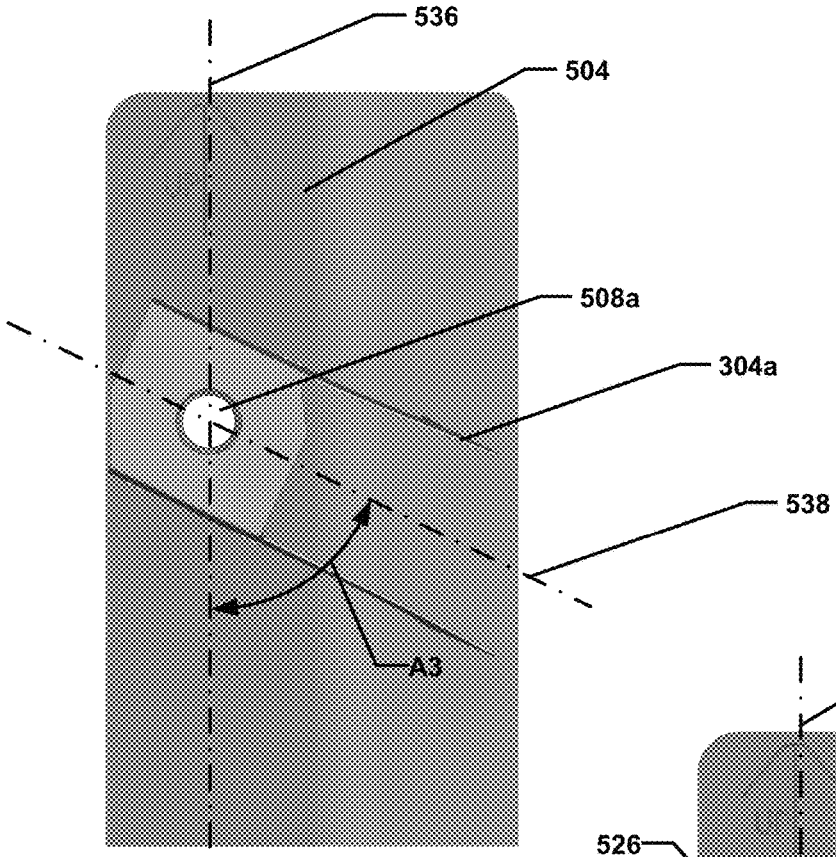
FIG. 6 is an enlarged partial view of area 6-6 of FIG. 5.
Figure 7:
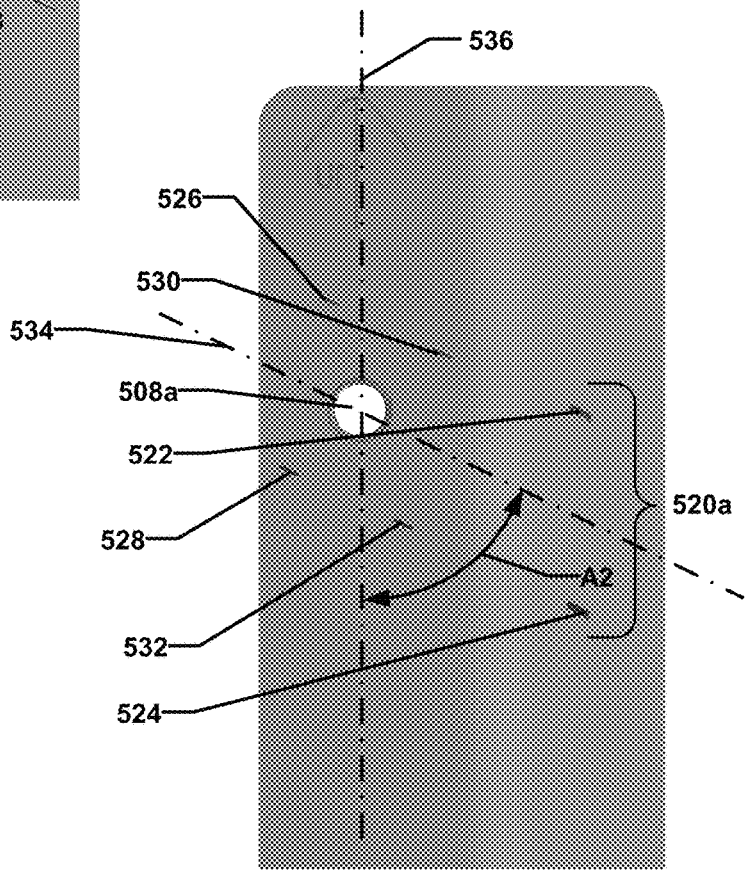
FIG. 7 is a detailed view of the blade without the spacer.
Figure 8:
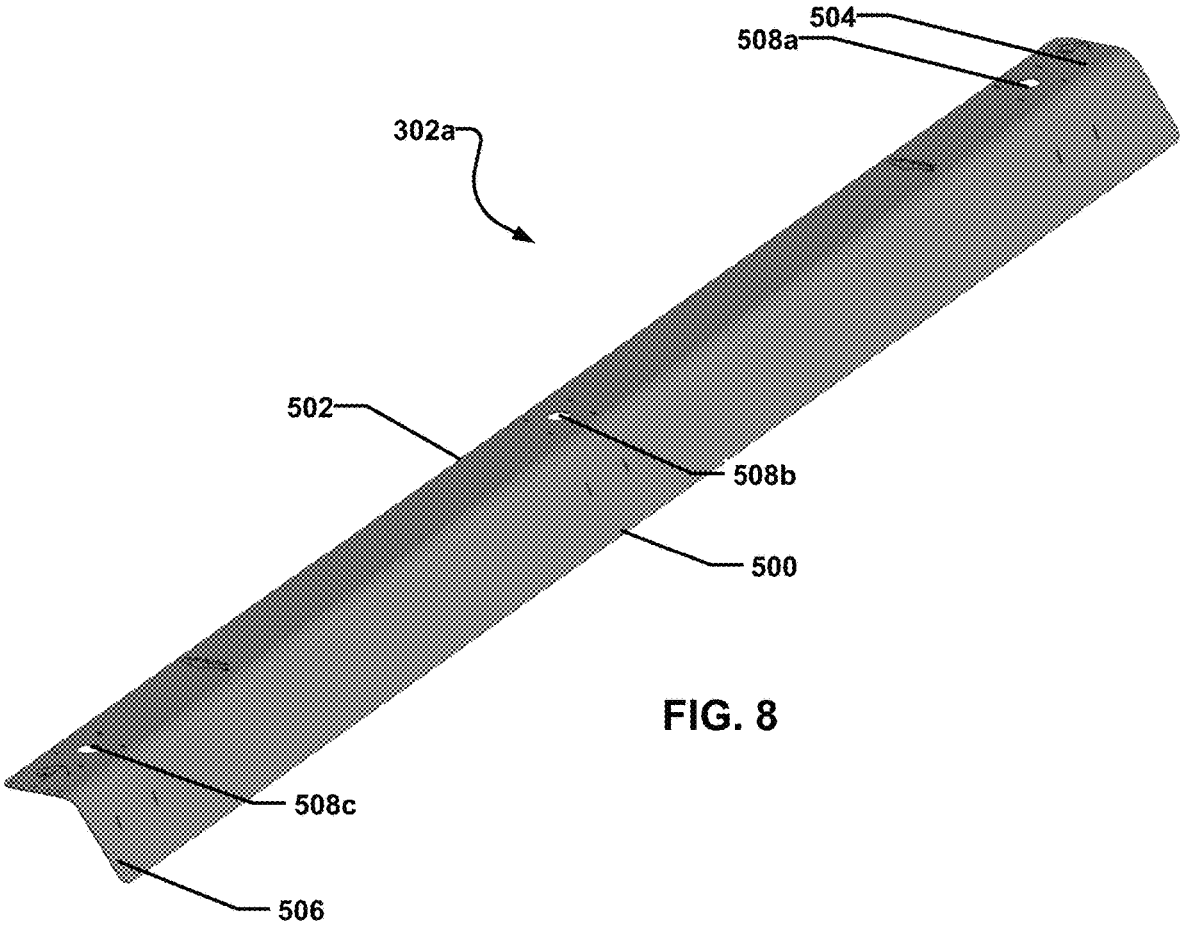
FIG. 8 is a perspective view of the blade.

As depicted in FIG. 7, an alignment slot array 520*a*-520*c* may be positioned around each bolt hole 508*a*-508*c*. Each alignment slot array 520*a*-520*c* may include a first front alignment slot 522 and a second front alignment slot 524 spaced apart from the first front alignment slot 522. The second front alignment slot 524 may be parallel to the first front alignment slot 522. Each alignment slot array 520*a*-520*c* may also include a first rear alignment slot 526 spaced apart from the first front alignment slot 522 and a second rear alignment slot 528 spaced apart from the first rear alignment slot 526. The second rear alignment slot 528 may be parallel to the first rear alignment slot 526. Further, each alignment slot array 520*a*-520*c* may include a first middle alignment slot 530 between the first front alignment slot 522 and the first rear alignment slot 526 and a second middle alignment slot 532 between the second front alignment slot 524 and the second rear alignment slot 528 and spaced apart from the first middle alignment slot 530. The second middle alignment slot 532 may be parallel to the first middle alignment slot 530. As will be described herein, the alignment slots 522-532 are sized, shaped and positioned to receive portions of the spacer 304*a* (see FIG. 6), which stabilizes the position of the spacer 304*a* relative to the first blade 302*a*.

As indicated in FIG. 7, each alignment slot array 520*a*-520*c* may include a central axis 534. The central axis 534 of each alignment slot array 520*a*-520*c* may form an angle, A2, with respect to a longitudinal axis 536 extending along a length of the blade 302*a*. In a particular aspect, A2 may be less than or equal to 80°, such as less than or equal to 75°, less than or equal to 70°, or less than or equal to 65°. In another aspect, A2 may be greater than or equal to 45°, such as greater than or equal to 50°, greater than or equal to 55°, greater than or equal to 60°, or greater than or equal to 65°. It is to be understood that A2 may be within a range between, and including, any of the maximum and minimum values of A2 described herein.

The spacer 304*a* may be installed such that portions of the spacer 304*a*, described below, extend into and through the alignment slots 522-532 of the first alignment slot array 520*a* of the first blade 302*a*. As depicted in FIG. 6, due to the position of the alignment slots 522-532 of the first alignment slot array 520*a*, the spacer 304*a* may be installed at an angle with respect to the first blade 302*a*. In particular, a central axis 538 of the spacer 304*a* may form an angle, A3, with respect to the longitudinal axis 536 that may extend along a length of the blade 302*a*. It should be noted that, when the spacer 304*a* is engaged with the alignment slots 522-532, the central axis 534 of the alignment slots coincides with the central axis 538 of the spacer 538.

A3 may be equal to A2. Further, A3 may be less than or equal to 80°, such as less than or equal to 75°, less than or equal to 70°, or less than or equal to 65°. In another aspect, A3 may be greater than or equal to 45°, such as greater than or equal to 50°, greater than or equal to 55°, greater than or equal to 60°, or greater than or equal to 65°. It is to be understood that A3 may be within a range between, and including, any of the maximum and minimum values of A3 described herein.

Figure 9:
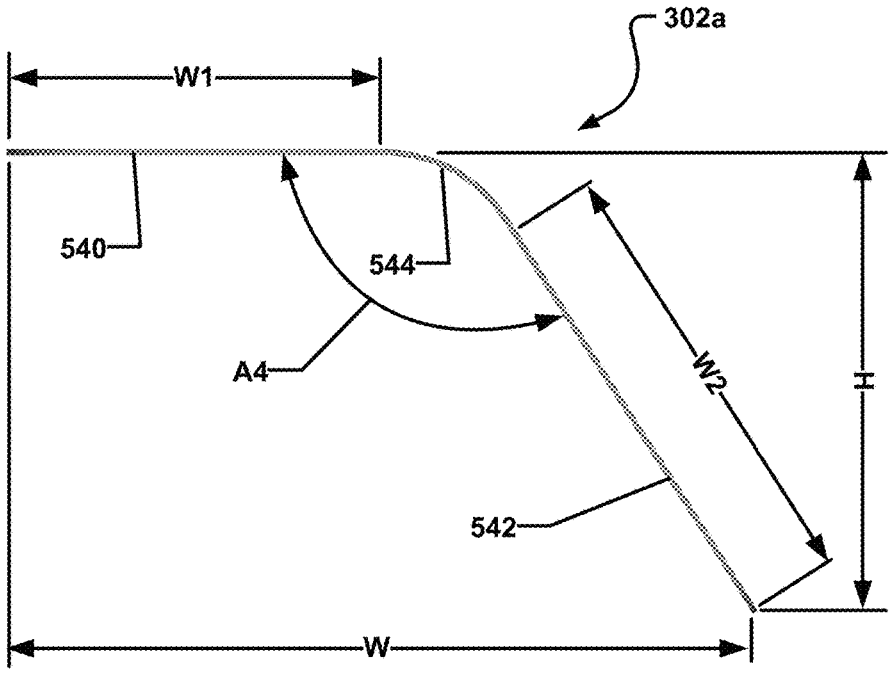
FIG. 9 is an end elevational view of the blade.

As shown in FIG. 9, the first blade 302*a* may have a cross-sectional shape that is generally V-shaped. The first blade 302*a* may include a generally linear outer leg 540 that terminates at the inner edge 500. The first blade 302*a* may also include a generally flat inner leg 542 that terminates at the outer edge 502. The inner leg 542 may be connected to the outer leg 540 by a curved portion 544. When installed in the louver assembly 300, the outer leg 540 of the first blade 302*a* may be substantially perpendicular to an axis 316*a*, 316*b*, 316*c* passing through one of the threaded bolts 306*a*, 306*b*, 306*c*, as indicated in FIG. 9, the inner leg 542 of the first blade 302*a* may form an angle, A4, with respect to the outer leg 540 of the first blade 302*a*. In a particular aspect, A4 may be greater than or equal to 100°. Further, A4 may be greater than or equal 105°, such as greater than or equal to 110°, greater than or equal to 115°, or greater than or equal to 120°. In another aspect, A4 may be less than or equal 135°, such as less than or equal to 130°, or less than or equal to 125°. In still another aspect, A4 may be 122°. It is to be understood that A4 may within a range between, and including, any of the minimum and maximum values of A4 described herein.

In a particular aspect, the outer leg 540 of the first blade 302*a* may have a width, W1, and W1 may be less than or equal to 2.0 inches, such as less than or equal to 1.95 inches, less than or equal to 1.90 inches, less than or equal to 1.85 inches, less than or equal to 1.80 inches, less than or equal to 1.75 inches, less than or equal to 1.70 inches, less than or equal to 1.65 inches, less than or equal to 1.60 inches, less than or equal to 1.55 inches, or less than or equal to 1.50 inches. In another aspect, W1 may be greater than or equal to 1.00 inches, such as greater than or equal to 1.05 inches, greater than or equal to 1.10 inches, greater than or equal to 1.15 inches, greater than or equal to 1.20 inches, or greater than or equal to 1.25 inches. It is to be understood that W1 may within a range between, and including, any of the maximum and minimum values of W1 described herein.

In yet another aspect, the inner leg 542 of the first blade 302*a* may have a width, W2, and W2 may be less than or equal to 2.25 inches, such as less than or equal to 2.20 inches, less than or equal to 2.15 inches, less than or equal to 2.10 inches, less than or equal to 2.00 inches, less than or equal to 1.95 inches, less than or equal to 1.90 inches, less than or equal to 1.85 inches, less than or equal to 1.80 inches, less than or equal to 1.75 inches, or less than or equal to 1.70 inches. In another aspect, W2 may be greater than or equal to 1.35 inches, such as greater than or equal to 1.40 inches, greater than or equal to 1.45 inches, greater than or equal to 1.50 inches, greater than or equal to 1.55 inches, or greater than or equal to 1.60 inches. It is to be understood that W2 may within a range between, and including, any of the maximum and minimum values of W2 described herein.

In another aspect, W1 is preferably equal to or less than W2. More preferably, W2 is at least 1.10 times W1. Most preferably, W2 is at least 1.25 times W1. It is to be understood that W1 may be within a range between, and including, any of the maximum and minimum values of W1 described herein.

In still another aspect, the curved portion 544 of the first blade 302*a* has a radius of curvature R that is preferably between 0.3 and 1.0 inches, more preferably, between 0.4 and 0.8 inches. It is to be understood that R may be within a range between, and including, any of the maximum and minimum values of R described herein.

Figure 5:
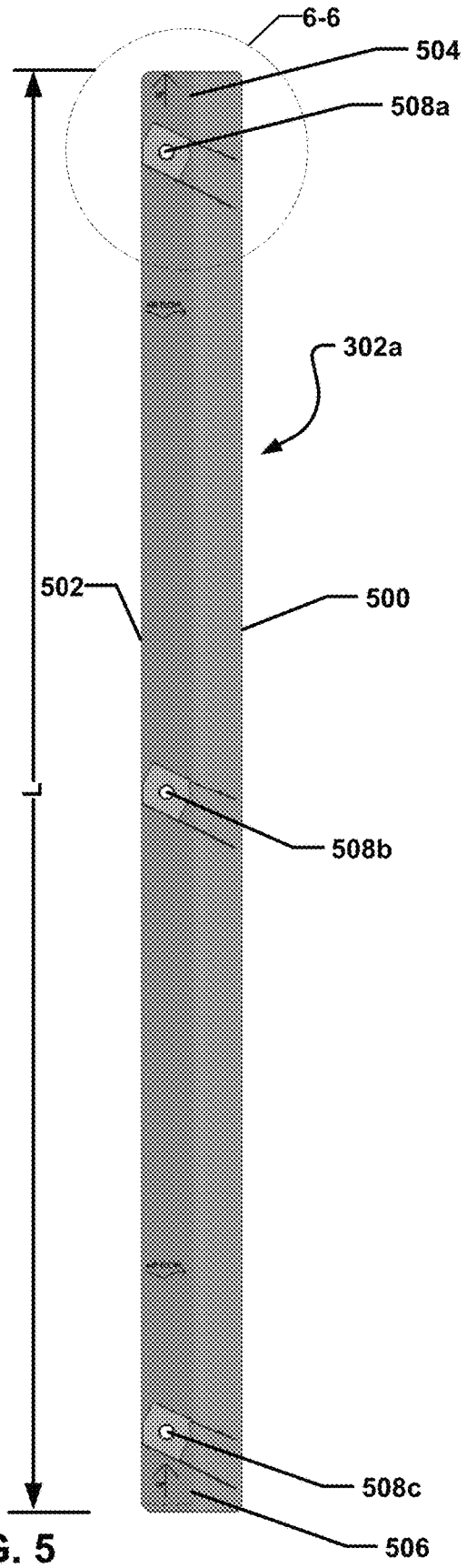
FIG. 5 is a side elevation view of a representative blade of the louver assembly with spacers installed thereon.

As indicated in FIG. 5 and FIG. 9, the first blade 302*a* may have an overall length, L; an overall width, W; and an overall height, H. In one aspect, L may be less than or equal to 120 inches, such as less than or equal to 96 inches, less than or equal to 84 inches, less than or equal to 72 inches, less than or equal to 60 inches, or less than or equal to 48 inches. Further, L may be greater than or equal to 24 inches, such as greater than or equal to 30 inches, or greater than or equal to 36 inches. It is to be understood that L may within a range between, and including, any of the minimum and maximum values of L described herein.

In another aspect, W may be less than or equal to 5 inches, such as less than or equal to 4.5 inches, less than or equal to 4.0 inches, less than or equal to 3.5 inches, or less than or equal to 3.25 inches. Further, W may be greater than or equal to 1.5 inches, such as greater than or equal to 1.75 inches, greater than or equal to 2.0 inches, greater than or equal to 2.25 inches, or greater than or equal to 2.5 inches. It is to be understood that W may within a range between, and including, any of the minimum and maximum values of W described herein.

In still another aspect, H may be less than or equal to 4 inches, such as less than or equal to 3.5 inches, less than or equal to 3.0 inches, less than or equal to 2.5 inches, or less than or equal to 2.0 inches. Further, H may be greater than or equal to 1.0 inches, such as greater than or equal to 1.25 inches, greater than or equal to 1.5 inches, or greater than or equal to 1.54 inches. It is to be understood that H may within a range between, and including, any of the minimum and maximum values of H described herein.

Referring now to FIG. 13 when a line 546, is drawn from the outer edge 502 of the second blade 302*b* to the inner edge of the second blade 302*b*, the line 313 may intersect the curved portion 544 of the first blade 302*a*. As such, when the louver assembly 300 is assembled as shown in FIG. 4, the nested arrangement of the blades 302*a*-302*o* may prevent sunlight from entering the cooling tower in which the louver assembly 300 is installed.

Figure 10:
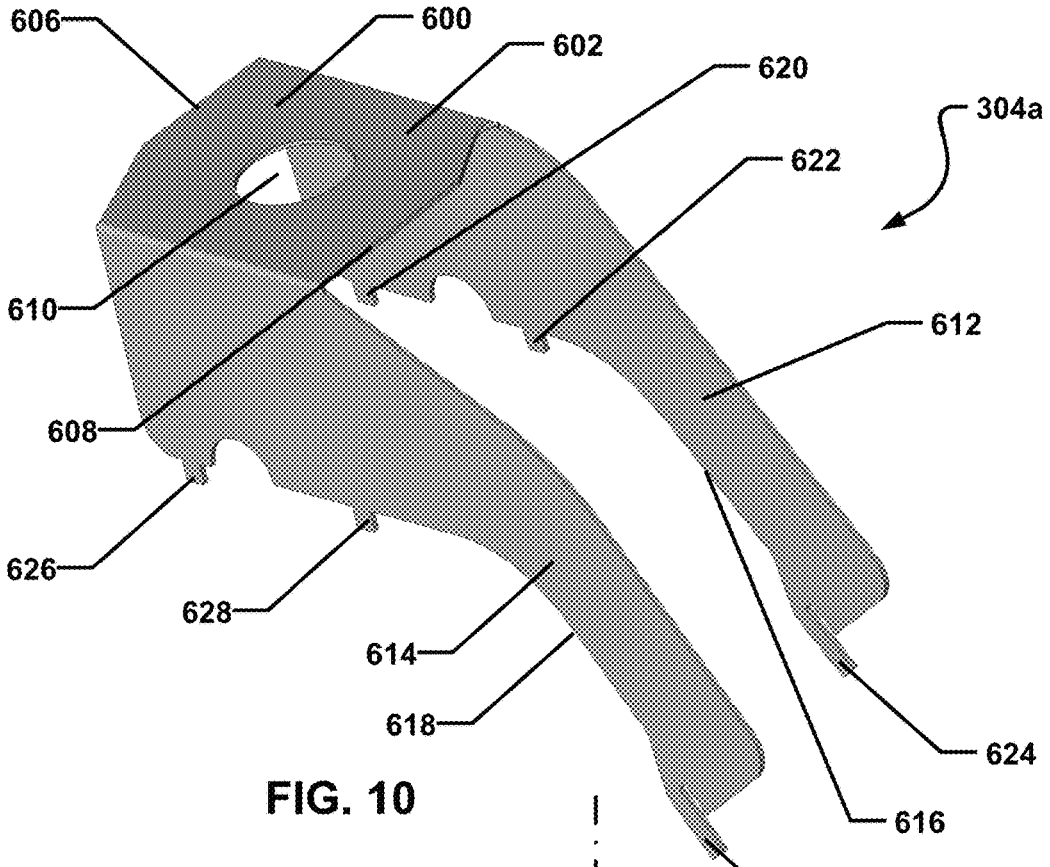
FIG. 10 is a perspective view of a representative spacer.
Figure 11:
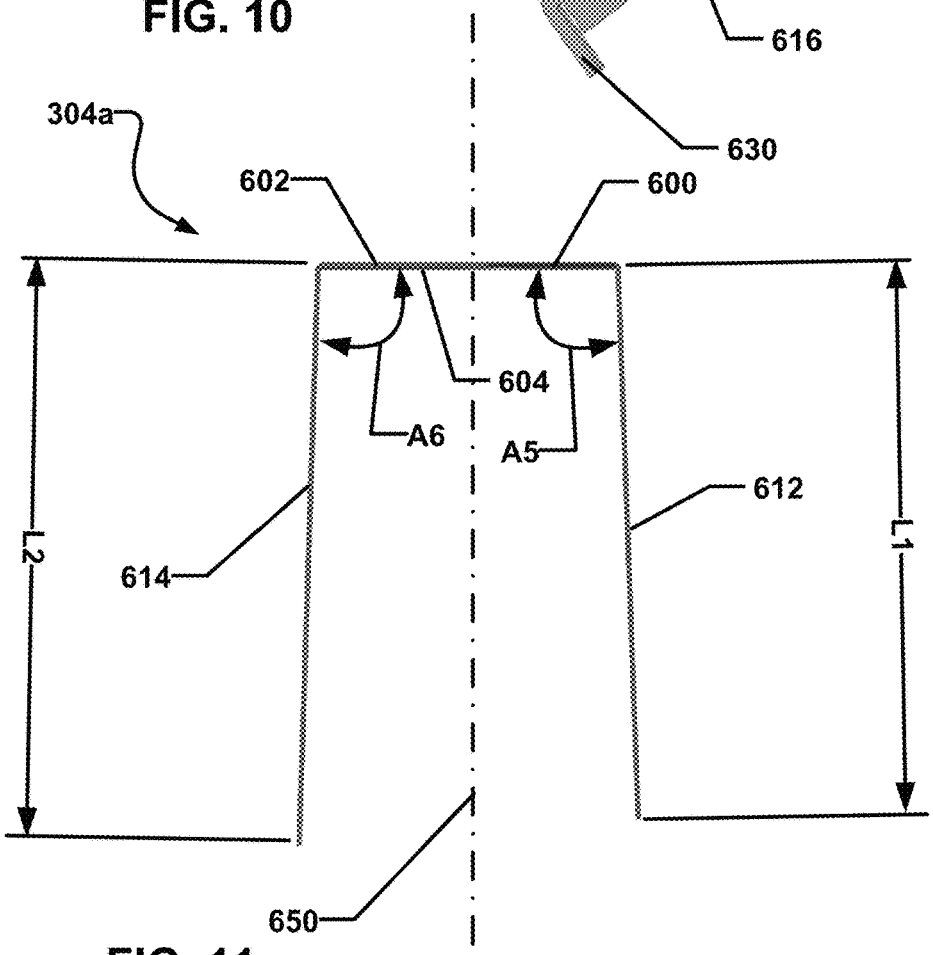
FIG. 11 is a front elevational view of the spacer.
Figure 12:
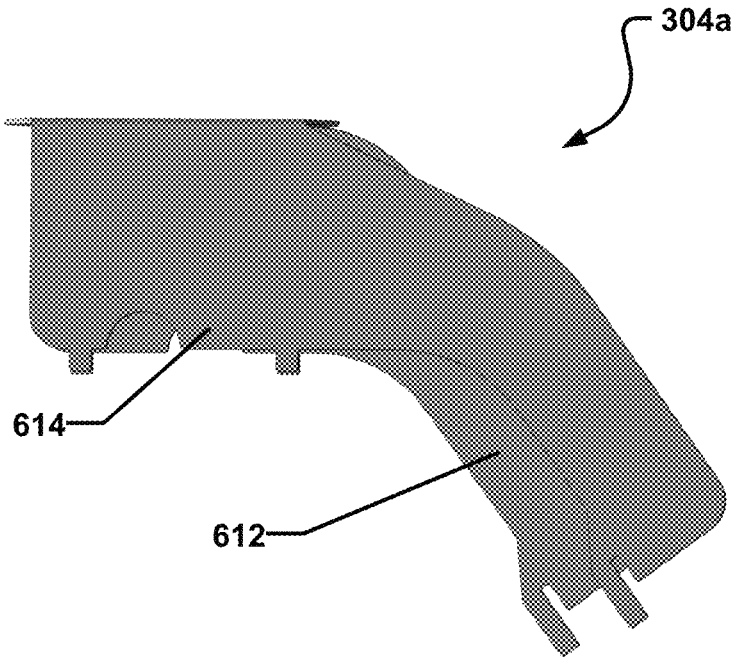
FIG. 12 is a side elevational view of the spacer.

FIG. 10 through FIG. 12, illustrate a single spacer, e.g., the first spacer 304*a*, which is representative of each of the plurality of spacers 304*a*-304*o* shown in FIG. 4 and FIG. 6. Referring to FIG. 10, the first spacer 304*a* may include a support strip 600 that may include an upper surface 602, a lower surface 604, a first strip edge 606, and an opposing second strip edge 608. A bolt hole 610 may be positioned between the first and second strip edges 606, 608 and may extend between the upper surface 602 and the lower surface 604 of the support strip 600.

As shown, the first spacer 304*a* may also include a first leg 612 that may extend in a generally downward direction from one side of the support strip 600 and a second leg 614 that may extend in a generally downward direction from an opposing side of the support strip 600. The first leg 612 may include a lower edge 616 that is sized and shaped to fit over and follow the contour of a blade, e.g., the first blade 302*a*. Specifically, the lower edge 616 of the first leg 612 may be sized and shaped, for example, to fit over the first blade 302*a* along a first plane that passes through the first front alignment slot 522, the first rear alignment slot 526, and the first middle alignment slot 530 of the first alignment slot array 520*a*. The second leg 614 may also include a lower edge 618 that is sized and shaped to fit over and follow the contour of the first blade 302*a* along a second plane that passed through the second front alignment slot 524, the second rear alignment slot 528, and the second middle alignment slot 532 of the first alignment slot array 520*a*.

Accordingly, when positioned on a blade, e.g., the first blade 302*a*, as depicted in FIG. 7, the lower edges 616, 618 of the first spacer 304*a* may interface with the upper blade surface 510 of the first blade 302 when positioned at one of the alignment slot arrays 520*a*-520*c*. Due to the differing shapes along the first plane and the second plane, the first leg 612 and the second leg 614 of the first spacer 304*a* are shaped differently. As such, the first spacer 304*a*, is asymmetrically shaped across an axis passing through a center of the first spacer.

FIG. 10 further shows that the first spacer 304*a* may include a first front alignment tab 620 and a first middle alignment tab 622 that may extend in a generally downward direction from the bottom edge 616 of the first leg 612. The first spacer 304*a* may also include a first rear alignment tab 624 that may extend at an angle in a generally downward direction from the bottom edge 616 of the first leg 612. In a particular aspect, the first front alignment tab 620, the first middle alignment tab 622, and the first rear alignment tab 624 may be coplaner.

As depicted, the first spacer 304*a* may also include a second front alignment tab 626 and a second middle alignment tab 628 that may extend in a generally downward direction from the bottom edge 618 of the second leg 614. The first spacer 304*a* may include a second rear alignment tab 630 that may extend at an angle in a generally downward direction from the bottom edge 618 of the second leg 614. In a particular aspect, the second front alignment tab 626, the second middle alignment tab 628, and the first rear alignment tab 630 may be coplaner. Each of the alignment tabs 620-630 may be sized and shaped to interfit with a corresponding one of the alignment slots 522-532 of one of the alignment arrays 520*a*-520*c* of the first blade 302*a*, or other blades 302*b*-3020.

Specifically, the first front alignment tab 620 may fit into the first front alignment slot 522, the first middle alignment tab 622 may fit into the first middle alignment slot 530, and the first rear alignment tab 624 may fit into the first rear alignment slot 526. Moreover, the second front alignment tab 626 may fit into the second front alignment slot 524, the second middle alignment tab 628 may fit into the second middle alignment slot 532, and the second rear alignment tab 630 may fit into the second rear alignment slot 530.

FIG. 11 shows that the first leg 612 may have a length, L1, and the second leg 614 may have a length, L2, and L2 may be greater than L1. For example, L2 may be greater than or equal to 1.01*L1, such as greater than or equal to 1.02*L1, greater than or equal to 1.03*L1, or greater than or equal to 1.04*L1. In another aspect, L2 may be less than or equal to 1.10*L1, such as less than or equal to 1.09*L1, less than or equal to 1.08*L1, less than or equal to 1.07*L1, less than or equal to 1.06*L1, or less than or equal to 1.05*L1. It is to be understood that L2 may be within a range between, and including, any of the minimum and maximum values of L2 described herein.

FIG. 11 further shows that the first leg 612 may form an angle, A5, with respect to the support strip 600. Further, the second leg 614 may form an angle, A6, with respect to the support strip 600. In a particular aspect, A5 may be equal to A6. Further, each of A5 and A6 may be greater than or equal to 90.00°, such as greater than or equal to 90.25°, greater than or equal to 90.50°, greater than or equal to 90.75°, greater than or equal to 91.00°, or greater than or equal to 91.25°. In another aspect, each of A5 and A6 may be less than or equal to 92.50°, such as less than or equal to 92.25°, less than or equal to 92.00°, less than or equal to 91.75°, or less than or equal to 91.50°. It is to be understood that each of A5 and A6 may be within a range between, and including, any of the minimum or maximum values of A5 and A6 described herein. FIG. 11 further shows that the spacer 304*a* is asymmetric about an axis 650 passing through the center of the bolt hole 610.

Referring again to FIG. 14, an exploded view of the louver assembly 300 is shown, in which some of the parts, represented by the three ellipses, are removed for clarity. FIG. 14 illustrates how the bolts 316*a*, 316*b* and nuts 318*a*-318*d* may be used to fully assemble the louver assembly 300. The blades 312*a*-312*e* are stacked alternately with three horizontal arrays 313*a*, 313*b* of spacers 314*a*-314*e*. The position of the spacers 314*a*-314*e* relative to the blades 312*a*-312*e* is fixed by the interlocking of alignment slots and tabs, as described above. Then, the bolts 316*a* are inserted through each of the horizontal arrays 313*a*, 313*b* and secured with nuts 318-318*d*.

When assembled, the louver assembly 300 may provide airflow into a cooling tower. Specifically, the shape of the blades 302*a*-302*o* and the nested arrangement of the blades 302*a*-302*o* and spacers 304*a*-304*o* may provide a way for air to enter a cooling tower while preventing water to splash out of the cooling tower via the air channels 310*a*-310*n* of the louver assembly 300. As water droplets fall down within the cooling tower, they will hit the angled spacers 304*a*-304*o* and the arrays 316*a*-316*c* formed thereby and flow back into the cooling tower for collection at the base of the cooling tower. Moreover, the nested arrangement of the blades 302*a*-302*o* may substantially prevent sunlight from passing through the louver assembly 300 via the air channels 310*a*-310*n* and into the cooling tower.

Referring now to FIGS. 15-18 another exemplary embodiment of a louver assembly is shown and is generally designated 1500. It is to be understood that the louver assembly 1500 may be installed as shown in FIG. 1 or FIG. 2. The louver assembly 1500 includes a plurality of blades 1502*a*-1502*q* that are spaced apart by a plurality of asymmetric spacers 1504*a*-1504*q* and arranged in a horizontally-aligned array. One layer of asymmetric spacers 1504*a*-1504*q* is preferably positioned between each of the blades 1502*a*-1502*q*. In this exemplary embodiment, each layer includes three asymmetric spacers 1504*a*-1504*q* and as described in greater detail below, each asymmetric spacer 1504*a*-1504*q* may be placed at an angle with respect to a longitudinal axis $L_b$ of the louver assembly 1500, or a longitudinal axis of each blade 1502*a*-1502*q* of the louver assembly 1500 (which is parallel to longitudinal axis $L_b$). In other embodiments, any number of spacers could be provided in each layer.

In this embodiment, the blades 1502*a*-1502*q* and spacers 1504*a*-1504*q* are held together by threaded bolts 1506 that are secured on each end by nuts 1508. Alternately, any suitable fastener could be substituted for the nuts 1508. For example, cotter pins, clamps, wire, clips, or a welded piece could be used, or the ends of the bolts could be bent or flattened to provide a fastening function. Each spacer (for example, spacer 1504*b*) is positioned between a pair of adjacent blades (for example, blades 1502*a*, 1502*b*), ensuing) and each pair of adjacent blades (for example, blades 1502*a*, 1502*b*) has two or more spacers of the plurality of spacers 1504*a*-1504*q* positioned therebetween (see, e.g., spacers 1504*a* and 1504*b* in FIG. 15), ensuring that an air channel 1510*a*-1510*q* is established between each adjacent pair of blades (for example, blades 1502*a*, 1502*b*).

Figure 18:
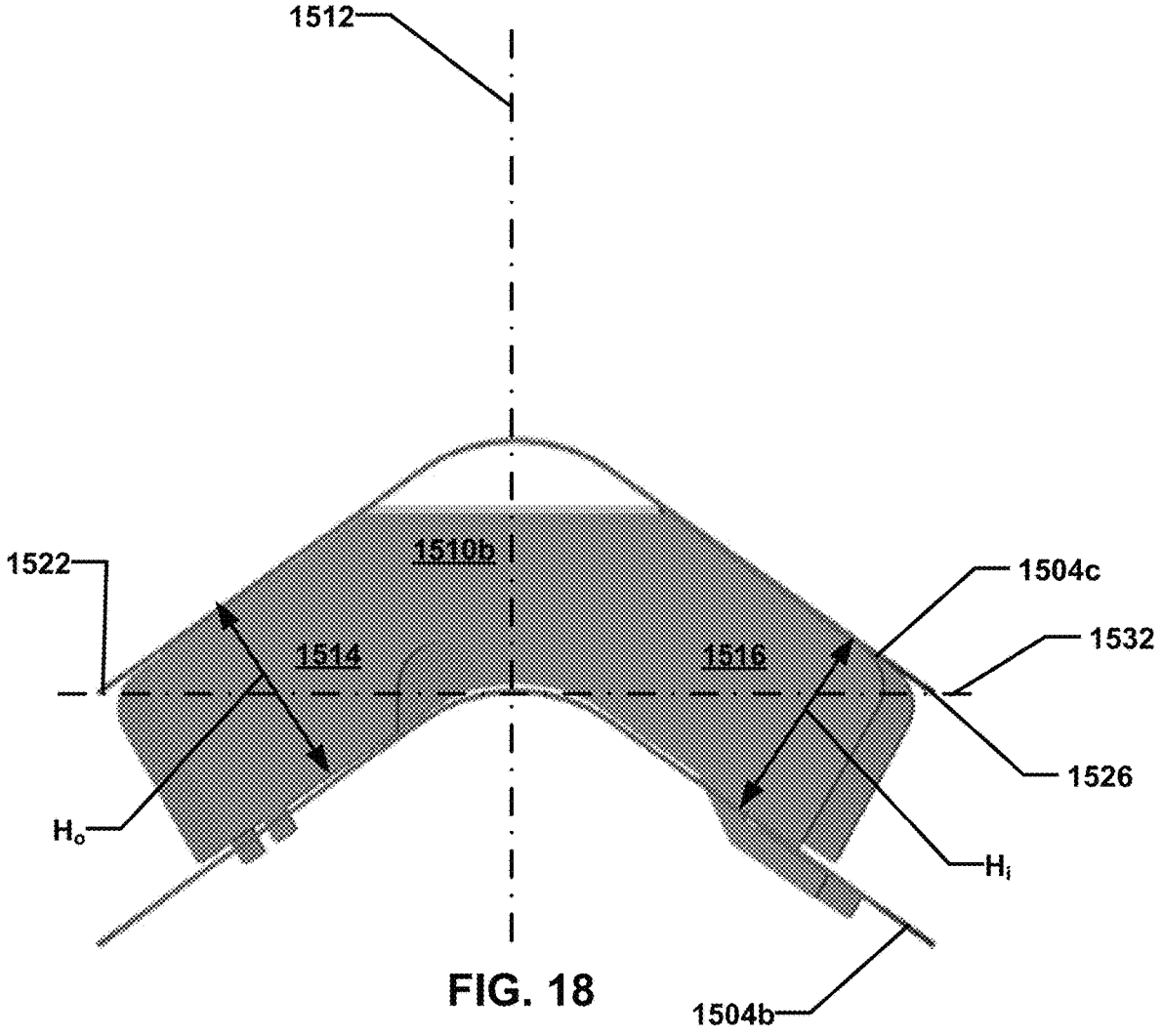
FIG. 18 is a top elevational view of the spacer installed between adjacent blades.

FIG. 18 illustrates a single air channel 1510*b*, which is representative of each of the air channels 1510*a*-1510*q* of the louver assembly 1500. As shown, the air channel 1510 is substantially symmetrical about a central axis 1512 and may include an outer portion 1514 and an inner portion 1516. As further illustrated in FIG. 18, the outer portion 1514 of the air channel 1510*b* may have a height, $H_o$, and the inner portion 1516 of the air channel 1510*b* may have a height, $H_i$. As shown in FIG. 18, $H_o$ is substantially equal to $H_i$. Further, $H_o$ and $H_i$ are between 0.7 and 1.0 inches.

Figure 15:
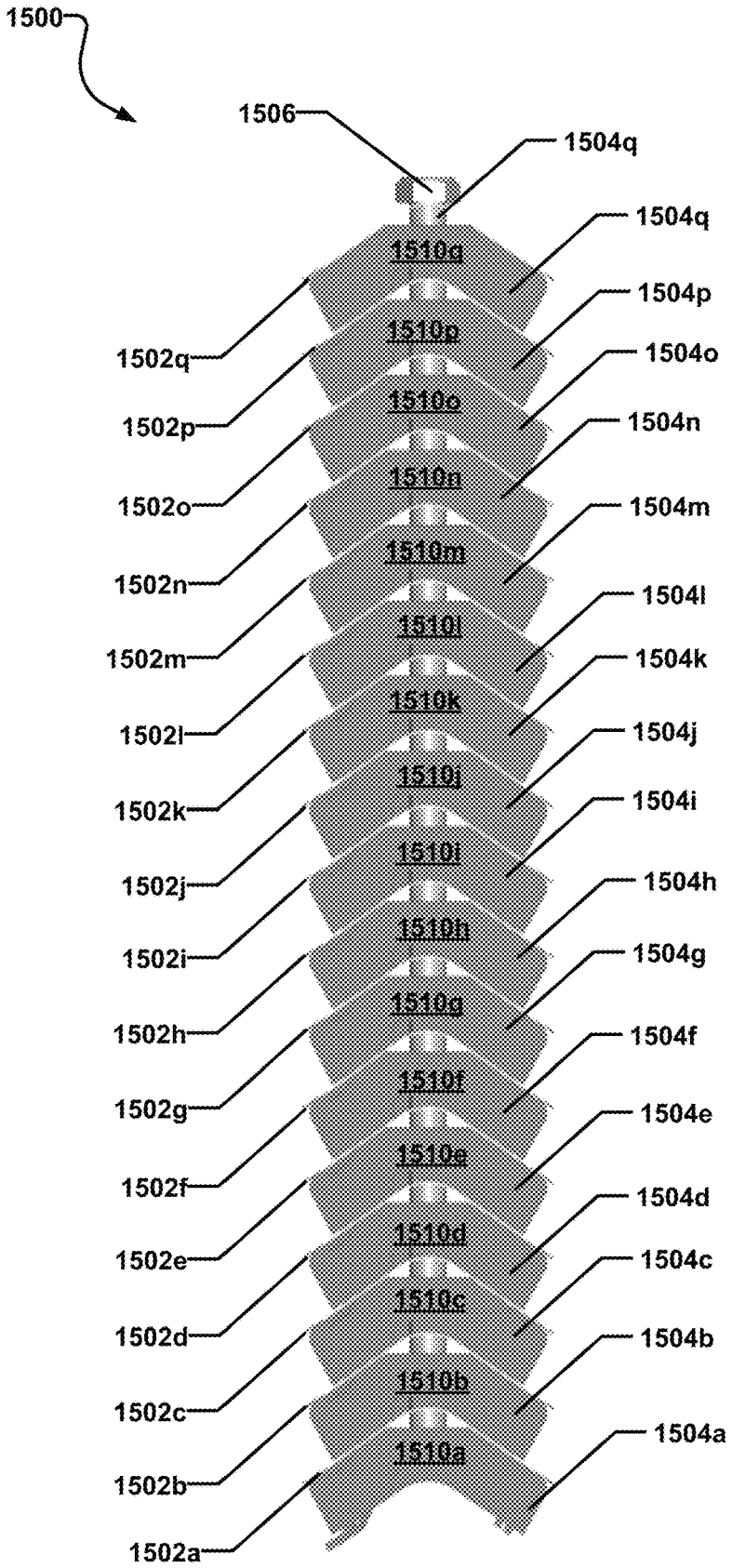
FIG. 15 is a top elevational view of a louver assembly.
Figure 16:
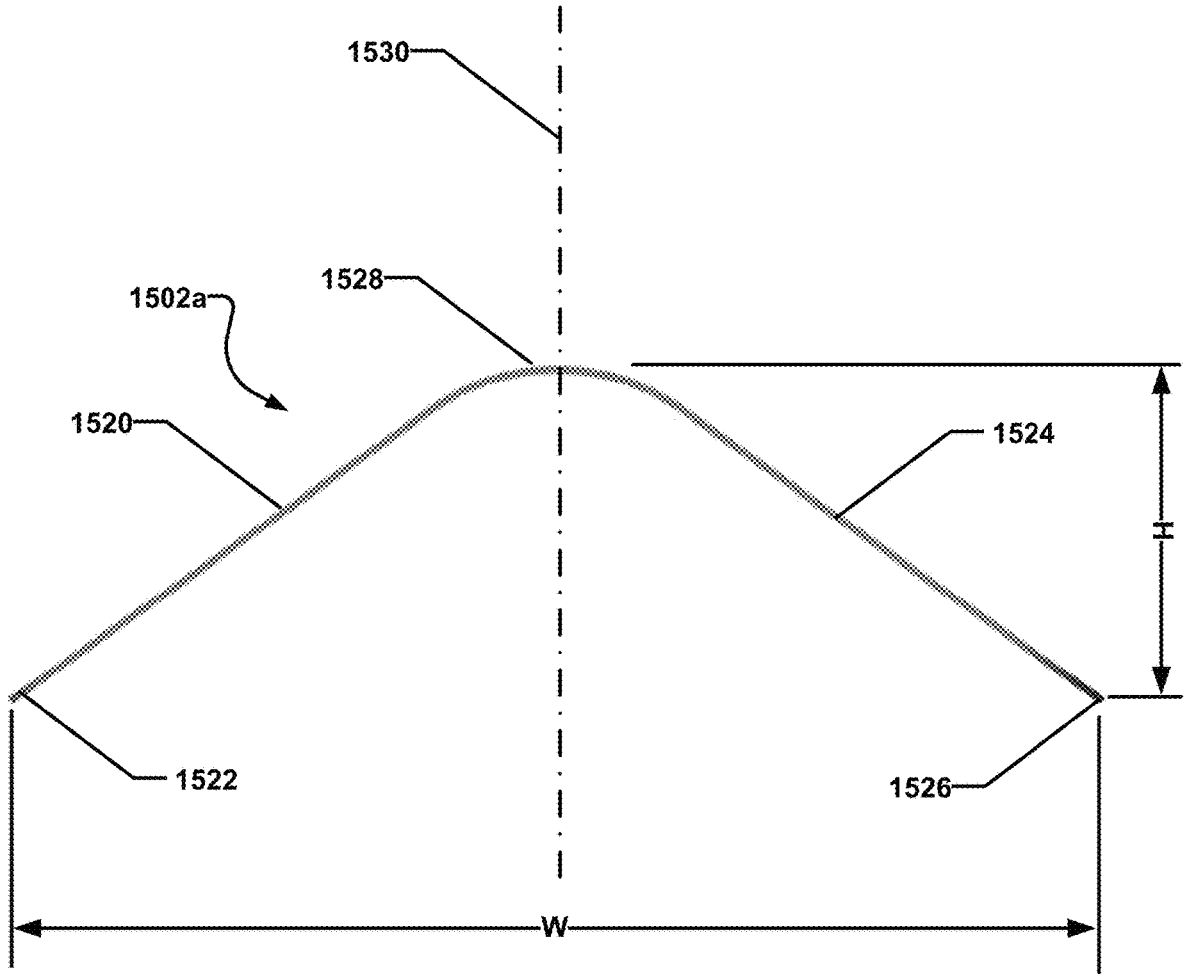
FIG. 16 is an end view elevational view of a blade.

FIG. 16 illustrates a first blade 1502*a*, which is representative of each of the plurality of blades 1502*a*-1502*q* shown in FIG. 15. As shown in FIG. 16, the first blade 1502*a* may have a cross-sectional shape that is generally V-shaped. The first blade 1502*a* may include a generally linear outer leg 1520 that terminates at an outer edge 1522. The first blade 1502*a* may also include a generally flat inner leg 1524 that terminates at the inner edge 1526. The inner leg 1524 may be connected to the outer leg 1520 by a curved portion 1528. As illustrated in FIG. 16, the first blade 1502*a* may be substantially symmetrical about a central axis 1530.

In still another aspect, the curved portion 1528 of the first blade 1502*a* has a radius of curvature R that is preferably between 0.3 and 1.0 inches, more preferably, between 0.4 and 0.8 inches. It is to be understood that R may be within a range between, and including, any of the maximum and minimum values of R described herein. As shown in FIG. 18, a shape and spacing of each of the plurality of blades 1504*b*, 1504*c* is adapted so that, for each of the plurality of blade pairs, a line 1532 extending from the inner edge 1526 of the upper blade 1504*c* to the outer edge 1522 of the upper blade intersects a portion of the lower blade 1504*b*.

As indicated in FIG. 16, the first blade 1502*a* may have an overall width, W, and an overall height, H. In one aspect, W may be less than or equal to 5 inches, such as less than or equal to 4.5 inches, less than or equal to 4.0 inches, less than or equal to 3.25 inches, or less than or equal to 2.5 inches. Further, W may be greater than or equal to 1.5 inches, such as greater than or equal to 1.75 inches, greater than or equal to 2.0 inches, greater than or equal to 2.25 inches, or greater than or equal to 2.5 inches. It is to be understood that W may within a range between, and including, any of the minimum and maximum values of W described herein.

In still another aspect, H may be less than or equal to 3.0 inches, such as less than or equal to 2.5 inches, less than or equal to 2.0 inches, less than or equal to 1.5 inches, or less than or equal to 1.0 inches. Further, H may be greater than or equal to 0.375 inches, such as greater than or equal to 0.50 inches, or greater than or equal to 0.76 inches. It is to be understood that H may within a range between, and including, any of the minimum and maximum values of H described herein.

Figure 17:
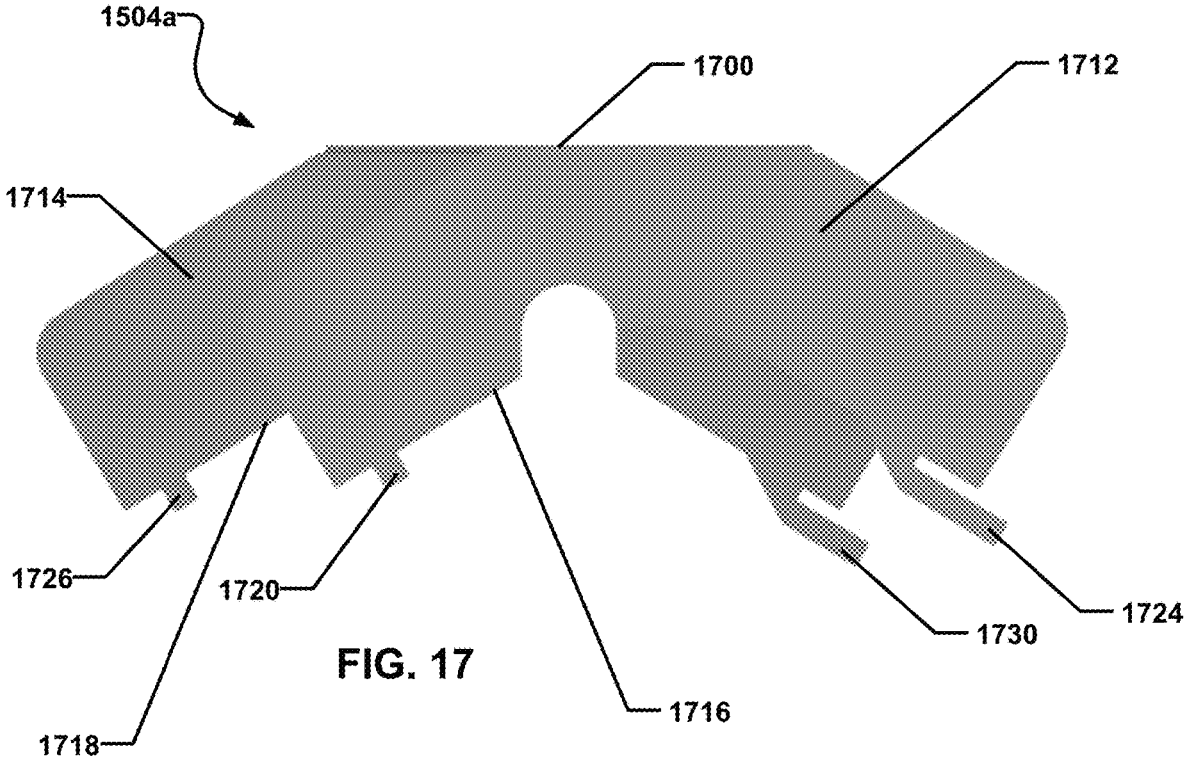
FIG. 17 is a side elevational view of a spacer.

FIG. 17, illustrates a single spacer, e.g., the first spacer 1504*a*, which is representative of each of the plurality of spacers 1504*a*-1504*q* shown in FIG. 4 and FIG. 6. Referring to FIG. 10, the first spacer 1504*a* may include a support strip 1700. The first spacer 1504*a* may include a first leg 1712 that may extend in a generally downward direction from one side of the support strip 1700 and a second leg 1714 that may extend in a generally downward direction from an opposing side of the support strip 1700. The first leg 1712 may include a lower edge 1716 that is sized and shaped to fit over and follow the contour of a blade, e.g., the first blade 1502*a*. The second leg 1714 may also include a lower edge 1718 that is sized and shaped to fit over and follow the contour of the first blade 1502*a*. It is to be understood that the first spacer

1504*a*, is asymmetrically shaped across an axis passing through a center of the first spacer.

FIG. 17 further shows that the first spacer 1504*a* may include a first front alignment tab 1720 in a generally downward direction from the bottom edge 1716 of the first leg 1712. The first spacer 1504*a* may also include a first rear alignment tab 1724 that may extend at an angle in a generally downward direction from the bottom edge 1716 of the first leg 1712. In a particular aspect, the first front alignment tab 1720 and the first rear alignment tab 1724 may be coplanar.

As depicted, the first spacer 1504*a* may also include a second front alignment tab 1726 that may extend in a generally downward direction from the bottom edge 1718 of the second leg 1714. The first spacer 1504*a* may include a second rear alignment tab 1730 that may extend at an angle in a generally downward direction from the bottom edge 1718 of the second leg 1714. In a particular aspect, the second front alignment tab 1726 and the second rear alignment tab 1730 may be coplanar. Each of the alignment tabs 1720, 1724, 1726, 1730 may be sized and shaped to interfit with a corresponding one of the alignment slots (not shown) of one of the alignment arrays (not shown) of the first blade 1502*a*, or other blades 1502*b*-1502*q*.

When assembled, the louver assembly 1500 may provide airflow into a cooling tower. Specifically, the shape of the blades 1502*a*-1502*q* and the nested arrangement of the blades 1502*a*-1502*q* and spacers 1504*a*-1504*q* may provide a way for air to enter a cooling tower while preventing water to splash out of the cooling tower via the air channels 1510*a*-1510*q* of the louver assembly 1500. As water droplets fall down within the cooling tower, they will hit the angled spacers 1504*a*-1504*q* and the arrays 1516*a*-1516*c* formed thereby and flow back into the cooling tower for collection at the base of the cooling tower. Moreover, the nested arrangement of the blades 1502*a*-1502*q* may substantially prevent sunlight from passing through the louver assembly 1500 via the air channels 1510*a*-1510*q* and into the cooling tower.

The assembly method and structure of the louver assemblies of the present invention provide modular systems that can be used to efficiently create louver assemblies of different sizes. Taller assemblies can be created simply by stacking a larger number of blades and spacers and providing longer bolts. Similarly, shorter assemblies can be provided by stacking a smaller number of blades and spacers and providing shorter bolts or cutting longer bolts. Assemblies having less length can be provided by either using shorter blades or cutting the blades to a shorter length. Regardless of the size, the same spacer part can be used.

All examples and conditional language recited herein are intended for pedagogical purposes to aid the reader in understanding the principles of the present invention and the concepts contributed by the inventor in furthering the art. As such, they are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It is to be understood that the embodiments described herein are merely exemplary and that a person skilled in the art may make many variations and modifications without departing from the spirit and scope of the invention. All such variations and modifications are intended to be included within the scope of the invention, as defined by the following claims.

The invention claimed is:

1. An apparatus comprising:

a blade array comprising a plurality of blades, each of the plurality of blades being spaced apart from an adjacent blade by a plurality of spacers, each of the plurality of blades having a longitudinal axis $L_B$, the longitudinal axis $L_B$ of each of the plurality of blades being collectively parallel, each of the plurality of spacers having a longitudinal axis $L_S$, wherein the longitudinal axis $L_S$ of each of the plurality of spacers is non-orthogonal to the longitudinal axis $L_B$.

2. The apparatus of claim 1, wherein the blade array and the plurality of spacers are secured and aligned by a plurality of rods, each of the plurality of rods having a longitudinal axis $L_R$, the longitudinal axis $L_R$ being orthogonal to the longitudinal axis $L_B$, each of the plurality of rods having a first rod end and second rod end and at least one fastener secured to each of the first and second rod ends.

3. The apparatus of claim 2, wherein each of the plurality of rods comprises a bolt, the first rod end is threaded, and the at least one fastener comprises a nut secured to the first rod end and a head located at the second rod end.

4. The apparatus of claim 2, wherein each of the plurality of rods extends through all of the plurality of blades.

5. The apparatus of claim 2, wherein each of the plurality of spacers is located in one of a plurality of spacer arrays and each of the plurality of rods passes through all of the spacers in one of the plurality of spacer arrays.

6. The apparatus of claim 1, wherein each of the plurality of blades comprises a plurality of alignment slots and each of the plurality of spacers comprises a plurality of alignment tabs, wherein each of the plurality of alignment slots is shaped and located to receive at least one of the alignment tabs.

7. The apparatus of claim 1, wherein each of the plurality of spacers has first and second legs connected by a support strip, the support strip having a rod aperture formed therein.

8. The apparatus of claim 1, wherein each of the plurality of blades comprises a linear outer leg and a linear inner leg that are connected by a curved portion.

9. The apparatus of claim 1, wherein each of the plurality of blades has an inner blade edge and an outer blade edge, the inner blade edge and the outer blade edge being parallel to the longitudinal axis $L_B$.

10. The apparatus of claim 1, wherein a longitudinal axis $L_S$ of each of the plurality of spacers forms an angle $A_3$ with the longitudinal axis $L_B$ of each of the plurality of blades, wherein angle $A_3$ is between 45 and 80 degrees.

11. The apparatus of claim 1, wherein a longitudinal axis $L_S$ of each of the plurality of spacers forms an angle $A_3$ with the longitudinal axis $L_B$ of each of the plurality of blades and the angle $A_3$ is substantially identical for each of the plurality of spacers.

12. A blade array comprising:

a plurality of blades, a plurality of spacers, a plurality of rods, each of the plurality of blades having a longitudinal axis $L_B$, an inner blade edge, an outer blade edge, the inner blade edge and the outer blade edge being parallel to the longitudinal axis $L_B$, each of the plurality of rods having first and second rod ends and a first fastener located at the first rod end a second fastener located at the second rod end;

wherein each of the plurality of blades and the plurality of spacers has at least one rod aperture and one of the plurality of rods extends through each of the at least one rod aperture;

wherein each of the plurality of blades is spaced apart from an adjacent one of the plurality of blades by at least two spacers of the plurality of spacers, thereby defining an air channel, each air channel having an upper blade of the plurality of blades and a lower blade of the plurality of blades; and wherein a shape and spacing of each of the plurality of blades is adapted so that, for each air channel, a line extending from the inner edge of the upper blade to the outer edge of the lower blade intersects a portion of the lower blade.

13. The blade array of claim 12, wherein each of the plurality of rods has a longitudinal axis $L_R$, the longitudinal axis $L_R$ being orthogonal to the longitudinal axis $L_B$ of each of the plurality of blades.

14. The blade array of claim 13, wherein each of the plurality of rods comprises a bolt, the first rod end is threaded, the first fastener comprises a nut, and second fastener comprises a bolt head locate at the second rod end.

15. The blade array of claim 12, wherein each of the plurality of rods extends through all of the plurality of blades.

16. The blade array of claim 12, wherein each of the plurality of blades comprises a plurality of alignment slots and each of the plurality of spacers comprises a plurality of alignment tabs, wherein each of the plurality of alignment slots is shaped and located to receive at least one of the alignment tabs.

17. The blade array of claim 12, wherein each of the plurality of spacers has first and second legs connected by a support strip, the support strip having one of the plurality of rod apertures formed therein.

18. The blade array of claim 12, wherein each of the plurality of blades comprises a linear outer leg and a linear inner leg that are connected by a curved portion.

19. The blade array of claim 18, wherein the curved portion has a radius of curvature R that is between 0.4 and 0.8 inches.

20. The blade array of claim 18, wherein at least two of the plurality of rod apertures is located in the curved portion of each of the plurality of blades.

* * * * *